US011060238B1

(12) United States Patent
Cruz

(10) Patent No.: US 11,060,238 B1
(45) Date of Patent: Jul. 13, 2021

(54) LAUNDRY APPARATUS

(71) Applicant: Elias David Cruz, Round Rock, TX (US)

(72) Inventor: Elias David Cruz, Round Rock, TX (US)

( * ) Notice: Subject to any disclaimer, the term of this patent is extended or adjusted under 35 U.S.C. 154(b) by 217 days.

(21) Appl. No.: 16/050,869

(22) Filed: Jul. 31, 2018

Related U.S. Application Data

(63) Continuation-in-part of application No. 15/468,037, filed on Mar. 23, 2017.

(51) Int. Cl.
*D06F 89/02* (2006.01)
*D06F 89/00* (2006.01)
*D06F 95/00* (2006.01)

(52) U.S. Cl.
CPC ..... *D06F 89/02* (2013.01); *D06F 89/005* (2013.01); *D06F 95/006* (2013.01)

(58) Field of Classification Search
CPC ..... D06F 89/02; D06F 95/00–006; D05B 89/023; D05B 89/026
See application file for complete search history.

(56) References Cited

U.S. PATENT DOCUMENTS 401,078 A 4/1889 Smith
2,010,333 A 8/1935 Steele
2,567,385 A 9/1951 Lighter
5,060,795 A * 10/1991 Bomes ..... A45C 3/004 206/279
5,082,466 A * 1/1992 Rubenstein ..... D04B 21/12 383/117
5,789,368 A * 8/1998 You ..... D06F 43/00 383/117
6,360,927 B1 * 3/2002 Barker ..... D06F 89/02 223/37
D475,193 S * 6/2003 Fernandez ..... B65B 63/045 D2/999
7,185,380 B2 3/2007 Barnabas et al.
9,022,259 B2 * 5/2015 Breier ..... D06F 89/023 223/38
D790,845 S * 7/2017 Greenspon ..... D2/999

FOREIGN PATENT DOCUMENTS

DE 299205 U1 6/2001

* cited by examiner

*Primary Examiner* — Clinton T Ostrup
*Assistant Examiner* — Andrew Wayne Sutton
(74) *Attorney, Agent, or Firm* — Keeley DeAngelo LLP; W. Scott Keeley

(57) ABSTRACT

The present disclosure relates to a method and apparatus for protecting a garment from wrinkling, stretching or abrasion during washing, drying and storing of the garment. Permeable sections has mesh stretched over them. A garment is folded about and within each section. The garment maximizes the flow of fluids through the garment while minimizing the wrinkling, stretching or abrasion of the garment during washing, drying and storing.

4 Claims, 10 Drawing Sheets

100

100

100

100

100

100 x/x

100

LAUNDRY APPARATUS

CLAIM OF PRIORITY

The present non-provisional patent application is a continuation-in-part of U.S. non-provisional application Ser. No. 15/468,037 having a filing date of Mar. 23, 2017, which claims priority to provisional patent application No. 62/329,914 having a filing date of Apr. 29, 2016.

TECHNICAL FIELD

The presently-disclosed subject matter relates in general to the field of laundry and clothing storage and more specifically to devices used for folding, washing, drying and storing garments.

BACKGROUND

Washing and drying of clothes in washing machines and dryers can cause shrinkage, color transfer and tears to fabrics. Drying with high heat shrinks garments more than drying with low heat. Washing also causes shrinkage and stretching; garment fabric deteriorates under friction; heat and pressure. Both washing and drying cause friction between garments of varying composition; this, plus the effects of heat, water, detergent, and rotational and agitation forces cause fabric to eventually break down.

A permanent-press setting on a dryer generally adds a cool-down period to the end of the drying cycle and intentionally leaves some moisture in the clothing to prevent wrinkling. It has been found that slower drying may prevent wrinkles and, over time, deterioration in clothing.

Garments and their compositional fabric tend to retain their structure when not subjected to agitation, pressure, heat or repeated washing. Garments that are stored or packed for travel are subject to mold or mildew from ambient moisture. Air movement through a storage area or through luggage can help mitigate mold and mildew growth on garments.

A folding board is commonly used to assist in the folding of garments. A board placed on a garment provides rectilinear edges to assist in making straight and perpendicular folds.

A structural apparatus that protects garments during the process of folding, washing, drying and storing would help retain the garment's integrity by fixing its structure during agitation in the washer or dryer. It would also allow garments to be dried at a lower setting and shorter duration than that of loose garments, because holding a garment open and flat exposes more of its surface area. An apparatus of this type would allow storage of a garment in its folded state, and would reduce mold or mildew by inviting air to move between the folds of a stored garment.

A spring hinge or spring-loaded hinge uses a spring to assist in closing or opening. The spring applies force to secure a hinge closed or opened. An offset hinge allows for larger openings. A hinge may be constructed of heavy fabric.

Thermoplastic elastomer is a copolymer material that is both elastomeric and thermoplastic and can be injection-molded.

SUMMARY

An example embodiment of the present disclosure is an apparatus and method for folding and fixing a garment to a flexible structure for washing, drying, and storing. An example apparatus is of a structured rectilinear permeable structure that allows fluid and detergent to flow through it and through a garment folded within it. The embodiment allows air to flow through the garment during drying and storing, at the same time maintaining the garment folded.

In an example embodiment, a set of four rectangular sections that frame planes of mesh material are engaged by hinges. The section is made of a semi-rigid material such as elastomer, polyurethane foam, or the like; it can flex in the washer and dryer. The embodiment's section is cut with apertures that allow water and air to flow through. Water flow and air flow through the woven mesh material, as well as through the permeable skeleton of the section, makes the embodiment lightweight for washing, drying and packing. One skilled in the art understands that surface material with any variety of combinations of apertures may create a permeable structural surface. Although a rectangular shape is disclosed, variations in the shape of the folding board may be made to accommodate variously shaped garments.

Although folding a shirt is described, one skilled in the art understands that the following method and apparatus may be used to assist in the folding of any garment. In this example embodiment, a shirt is laid flat upon the embodiment, with the bottom edge of the second rectangular section of the embodiment placed proximal to the neck opening of a shirt. Each section is folded upon the shirt until the shirt is folded within the embodiment into a rectangular, folded package.

One skilled in the art understands that hinges may be rigid, with a central pivot, or may be plastic, molded living hinges; and that some components use offset hinges to pivot over a thickness as one rectangular section may pivot and reside atop another rectangular section.

In one embodiment hinges are designed to snap both open and closed while under tension in the positions between open and closed. One skilled in the art is familiar with tensioned hinges that are used in eyeglass cases and the like. In another embodiment a fastening strap holds the embodiment to the garment. One skilled in the art understands that such straps are for the purpose of holding the folded garment in the embodiment and may be made of fabric, stretch fabric or elastic material, and that a fastening strip may use a hook-and-loop closure or any array of fasteners such as snaps, hooks or buttons.

The assembled shirt and mesh section assembly may then be put through a laundry cycle. The garment is protected from abrasion and pressure during washing, drying, and storing. In this example embodiment a garment is laundered with maximal flow of water and detergent, with the washing machine's agitation set to a minimum setting to reduce stretching and wear on the garment. In the dryer, the garment suffers minimal wrinkling and handling and adequate air flow through the embodiment's permeable membrane. The assembled garment and mesh assembly allow the setting of a low dryer heat, which helps reduce wrinkling, stretching or fabric deterioration. Once assembled into the embodiment, a shirt or any garment may be washed, dried, stored or packed. When stored or packed, a garment folded into the embodiment will receive air flow, which will reduce moisture buildup.

One skilled in the art understands that air and water are fluids and that a material that is permeable to air may also be configured to be permeable to water.

DETAILED DESCRIPTION OF THE DRAWINGS

Figure 1:
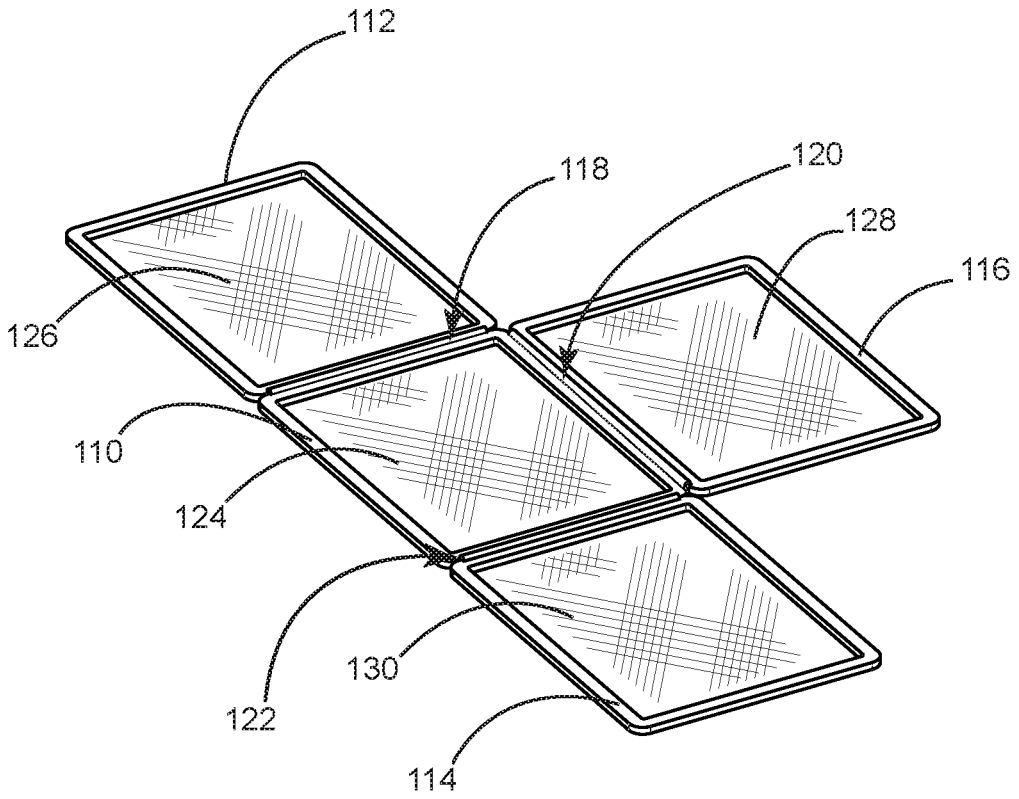
FIG. 1 is a front perspective view of an example embodiment.

In FIG. 1 an example embodiment is unfolded and ready to use. A four-part rectangular apparatus 100 is depicted in the illustration. Each section has a permeable membrane 124, 126, 128, 130 across it. The first rectangular section 110 is connected by a hinge 118 to a second rectangular section 112. The first rectangular section 110 is also connected by a right-side hinge 120 to a third rectangular section 116. The first rectangular section is further connected by a hinge 122 to a fourth rectangular section 114. Hinges may be of any sort, including "living," sprung-type, or fabric. In some embodiments hinge 120 and hinge 122 are offset hinges such that they close over other sections as demonstrated in FIGS. 9 and 10.

Figure 2:
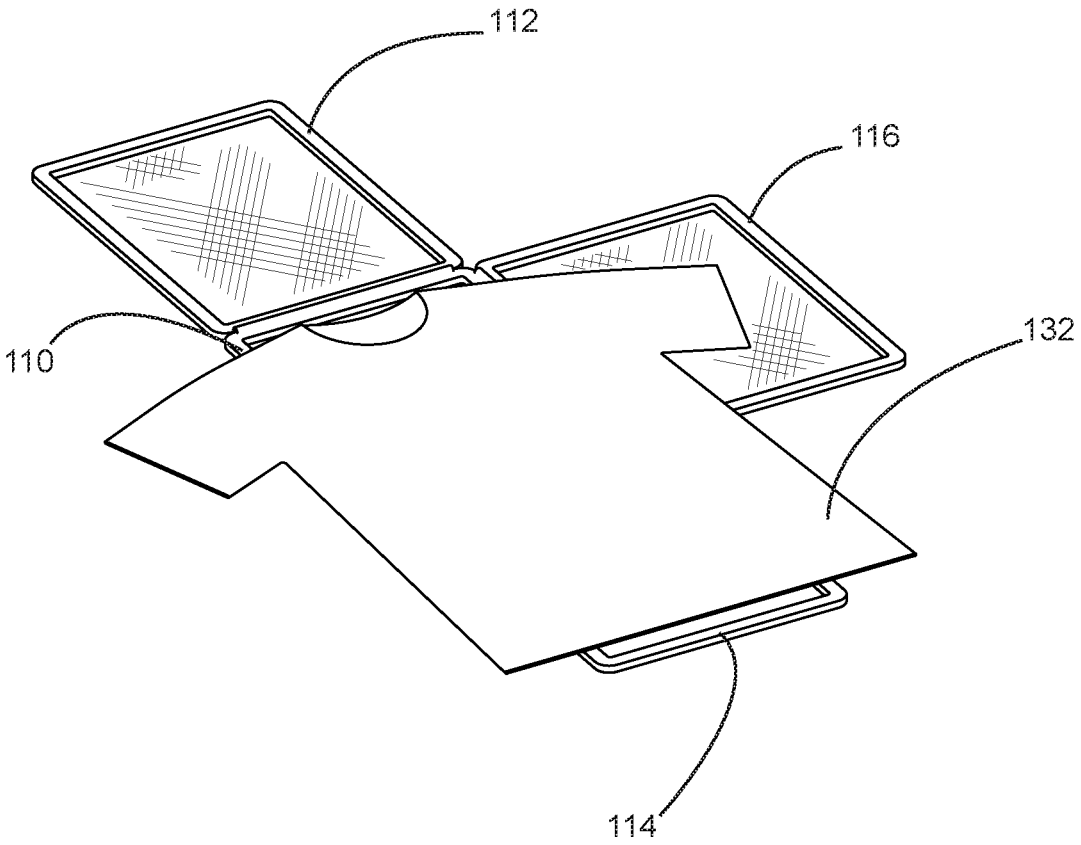
FIG. 2 is a front perspective view of an example embodiment with a provided garment.
Figure 3:
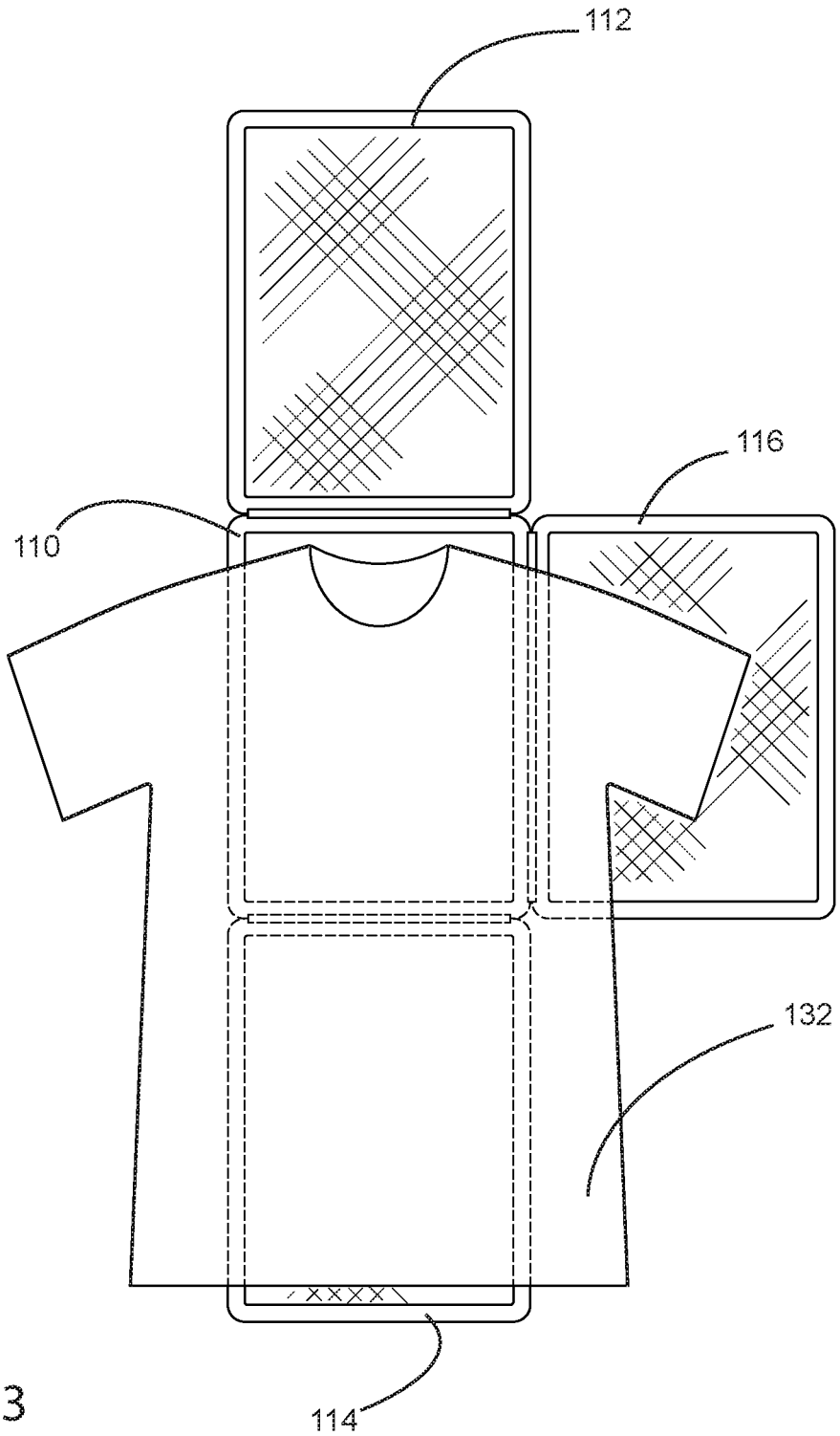
FIG. 3 is a plan view of the embodiment with a provided shirt laid atop, ready for folding with the embodiment.

In FIGS. 2. and 3., the embodiment 100 is shown in perspective view and plan view, respectively, with a garment 132 laid over the open embodiment. In the illustration the first rectangular section 110 is under the garment, as is the fourth rectangular section 114. Portions of the garment 132 rest atop the third rectangular section 116 and the second rectangular section 112 resides adjacent to and above the garment 132.

Figure 4:
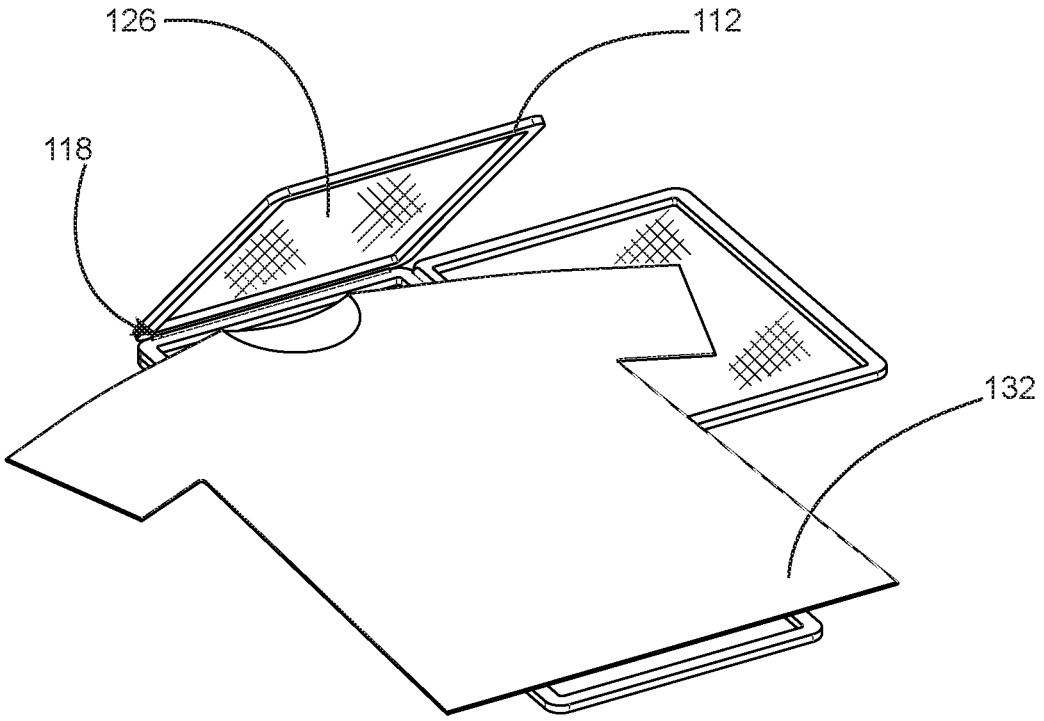
FIG. 4 is a perspective view showing the first step of the method, in which a garment is folded into the embodiment.
Figure 5:
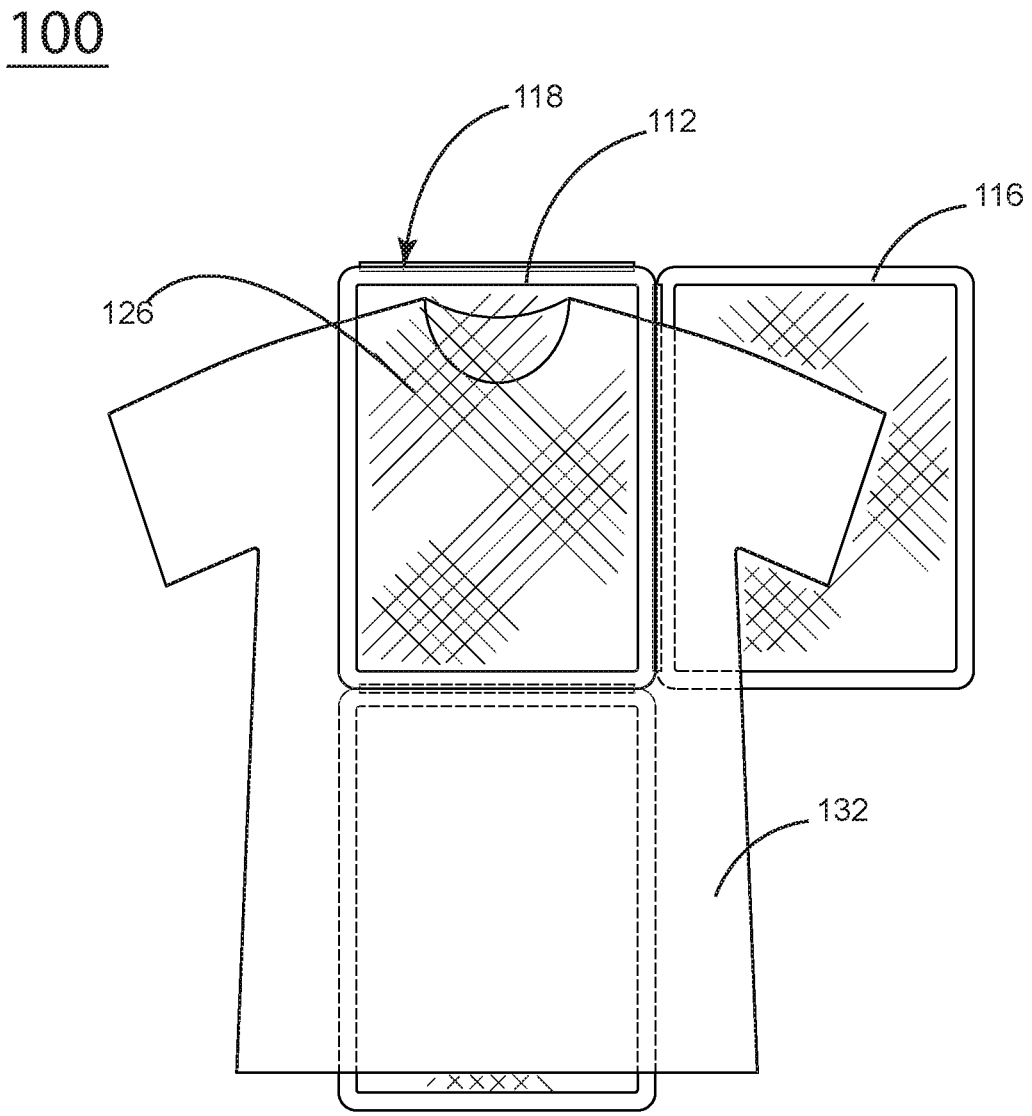
FIG. 5 is a plan view of the embodiment showing the top panel of the embodiment folded over a provided shirt.

In FIGS. 4 and 5, the embodiment 100 is shown in a perspective view and plan view respectively, with a garment 132 laid over the embodiment. In FIG. 4 the second rectangular section 112 with permeable surface 126 is shown partially rotated about hinge 118. In FIG. 5 the second rectangular section is shown fully rotated about hinge 118 and closed over the garment 132 with the permeable surface 126 residing atop the garment 132.

Figure 6:
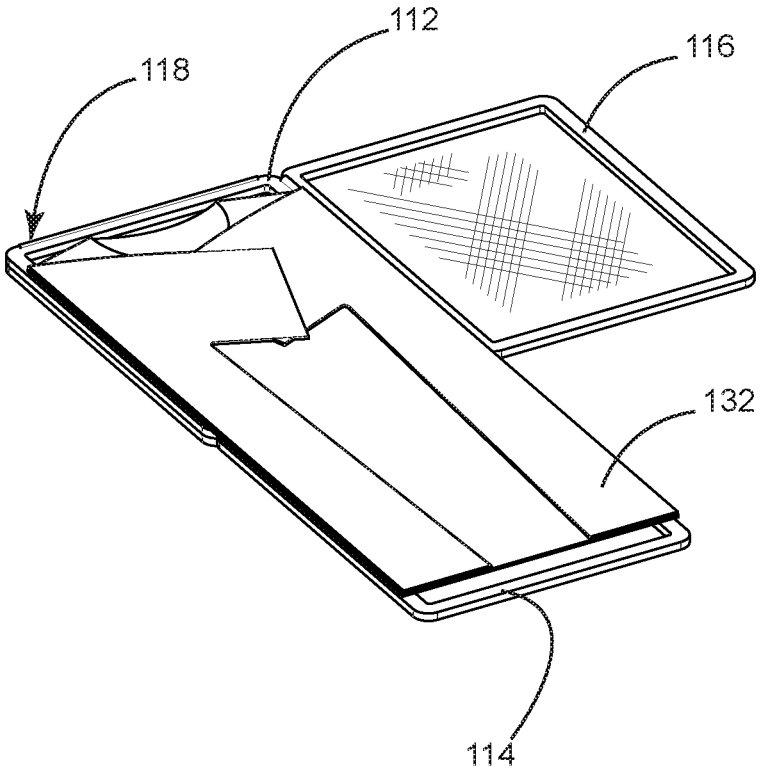
FIG. 6 is a perspective view showing the garment partially folded with the embodiment.
Figure 7:
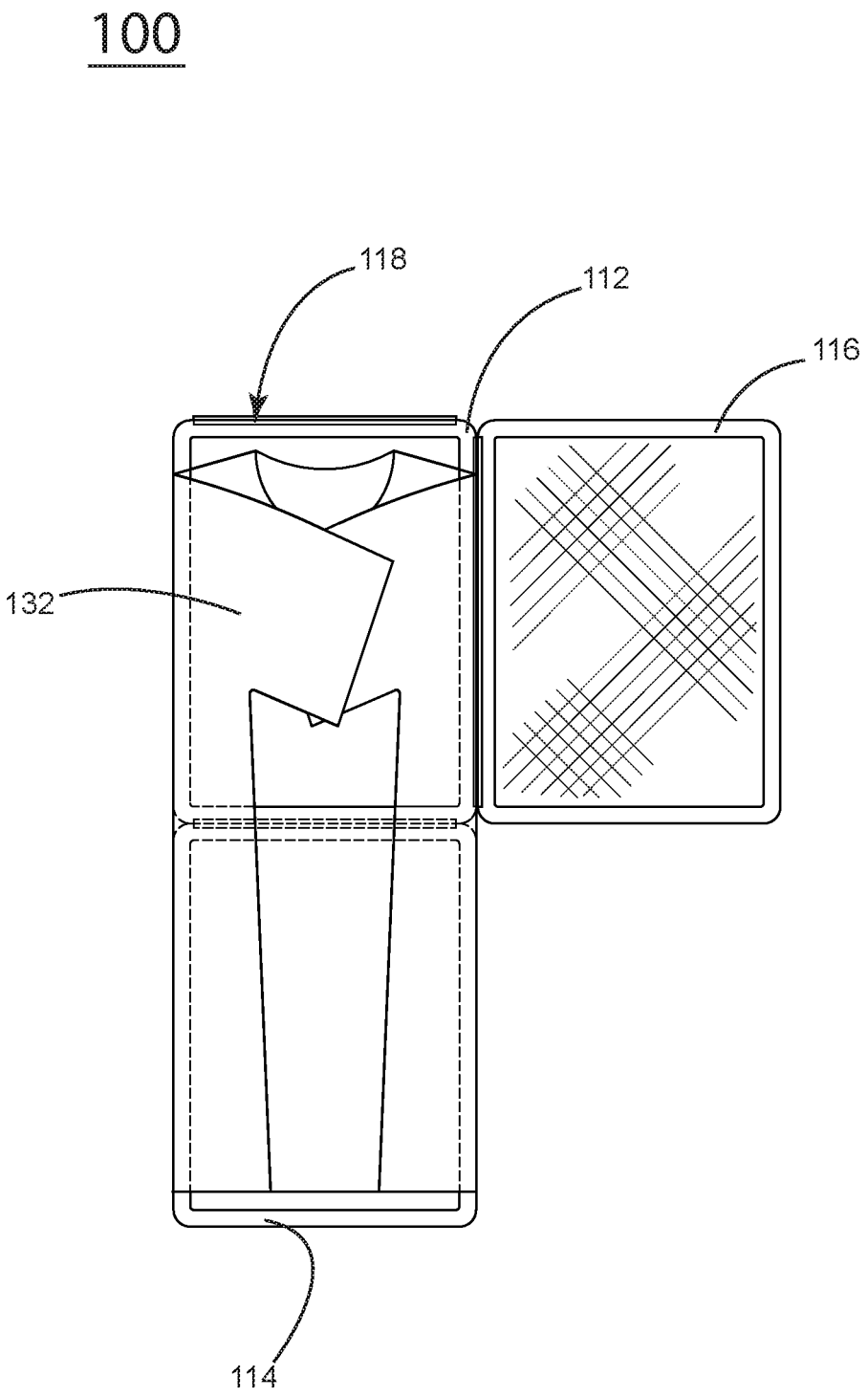
FIG. 7 is a plan view showing the embodiment partially folded under a garment.

In FIGS. 6 and 7, the embodiment 100 is shown in perspective view and plan view respectively, with a garment 132 partially folded over the partially closed embodiment. The second rectangular section 112 remains closed about hinge 118. The permeable surface 126 (FIG. 5) is omitted for clarity. The garment 132 is folded about the second rectangular section 112 and remains resting atop the fourth rectangular section 114. The third rectangular section 116 is shown for reference.

Figure 8:
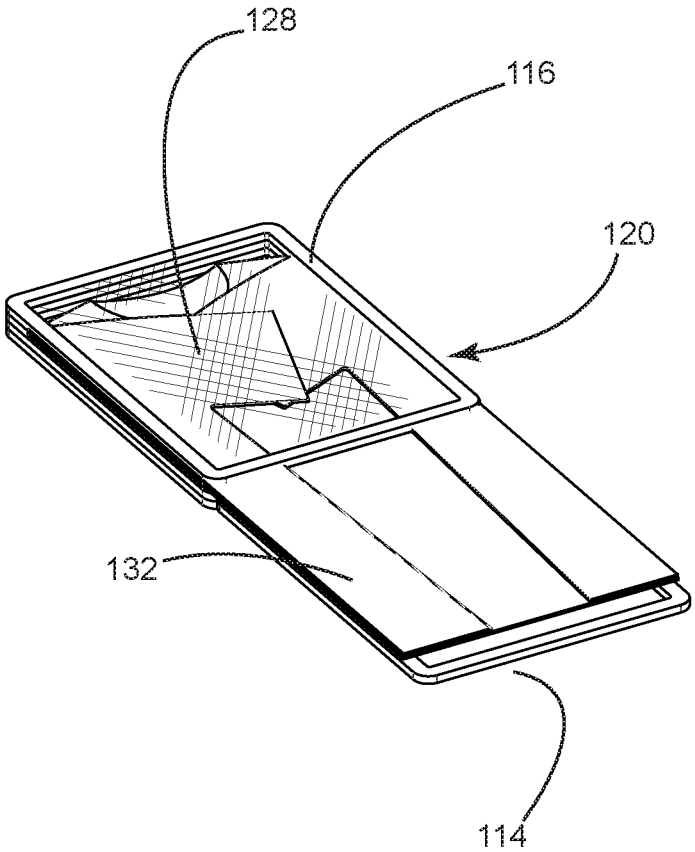
FIG. 8 is a perspective view of the embodiment, with a garment partially folded over the partially closed embodiment.
Figure 9:
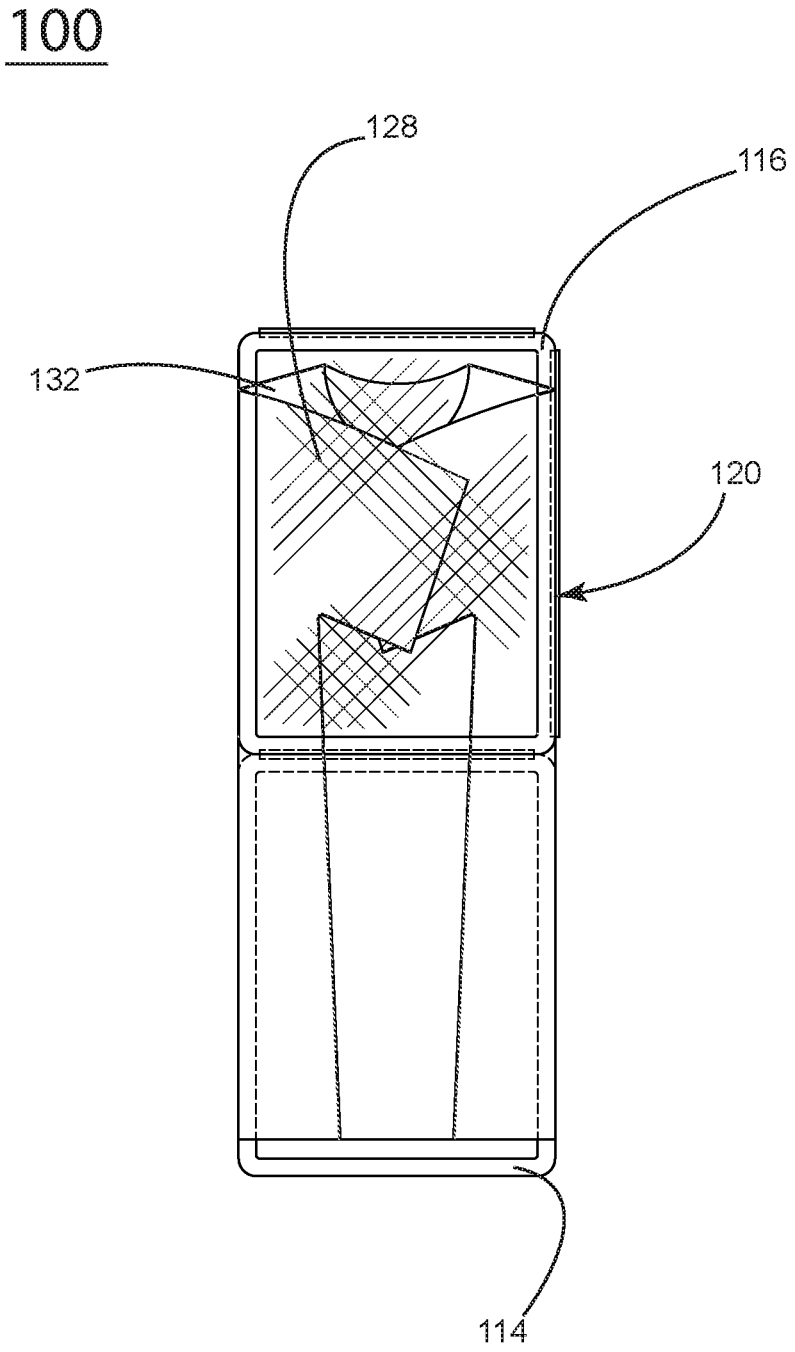
FIG. 9 is a plan view of the embodiment closed over the partially folded garment.

In FIGS. 8 and 9, the embodiment 100 is shown in a perspective view and plan view, respectively, with the lateral parts of the garment 132 folded inward around panels 1 and 4 (FIG. 1) of the embodiment, and the third panel of the embodiment 116, (FIGS. 8 and 9), folded over the folded shirt. A permeable surface 128 of the third panel 116 resides atop the partially folded garment 132.

Figure 10:
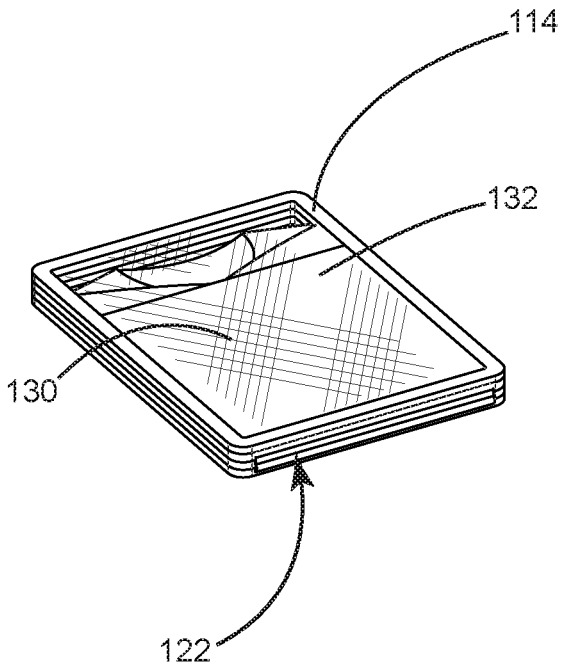
FIG. 10 is a perspective view of the embodiment in a closed position.

FIG. 10 shows a perspective view of the embodiment with the fourth rectangular section 114 rotated about the bottom-edge hinge 122 to a closed position, and the garment 132 folded along the hinge 122. A permeable surface 130 resides atop the garment 132. The spring-tension hinges serve to keep the embodiment closed, or a fastening means (not shown) might be placed across the embodiment. One skilled in the art understands fastening means such as Velcro straps and the like.

The invention claimed is:

1. An apparatus for protecting a garment during washing, drying and storing comprising:

a first rectangular section having a front surface, a back surface, a top edge, a bottom edge, a left edge and a right edge; and a second rectangular section having a front surface, a back surface, a top edge, a bottom edge, a left edge and a right edge; and a third rectangular section having a front surface, a back surface, a top edge, a bottom edge, a left edge and a right edge; and a fourth rectangular section having a front surface, a back surface, a top edge, a bottom edge, a left edge and a right edge; and the first rectangular section hingedly engaged along its top edge with the bottom edge of said second rectangular section; and the first rectangular section hingedly engaged along its right edge with said left edge of the third rectangular section; and the first rectangular section hingedly engaged along its bottom edge with said top edge of the fourth rectangular section; wherein wherein all of the hinges are spring-tension hinges; and a garment placed on the apparatus is held fast when the second rectangular section is closed over it, and the garment is folded over the second rectangular section, and the third rectangular section is closed over the garment, and the garment and fourth rectangular section are folded and closed over the first rectangular section, encasing the garment within the first, second, third and fourth rectangular sections; and the first rectangular section is hingedly engaged with an offset hinge along its right edge with said left edge of the third rectangular section; and as each rectangular section is closed about said garment, each rectangular section flexes the spring under tension until each rectangular section is moved to the closed position wherein the spring tension holds the rectangular section in a closed position.

2. The apparatus of claim 1 wherein the first rectangular section is hingedly engaged with an offset hinge along its bottom edge and with said bottom edge of the fourth rectangular section.

3. The apparatus of claim 1 further comprising a fastener to hold the assembled apparatus and garment closed.

4. An apparatus for protecting a garment during washing, drying and storing comprising:

a first rectangular section having a front surface, a back surface, a top edge, a bottom edge, a left edge and a right edge; and a fluid-permeable material stretched over said first rectangular section; and a second rectangular section having a front surface, a back surface, a top edge, a bottom edge, a left edge and a right edge; and a fluid-permeable material stretched over said second rectangular section; and a third rectangular section having a front surface, a back surface, a top edge, a bottom edge, a left edge and a right edge; and a fluid-permeable material stretched over said third rectangular section; and a fourth rectangular section having a front surface, a back surface, a top edge, a bottom edge, a left edge and a right edge; and a fluid-permeable material stretched over said fourth rectangular section; and the first rectangular section hingedly engaged along its top edge with the bottom edge of said second rectangular section; and the first rectangular section hingedly engaged along its right edge with said left edge of the third rectangular section; and the first rectangular section hingedly engaged along its bottom edge with said top edge of the fourth rectangular section; wherein a garment placed on the apparatus is held fast when the second rectangular section is closed over it, and the garment is folded over the second rectangular section, and the third rectangular section is closed over the garment, and the garment and fourth rectangular section are folded and closed over the first rectangular section, encasing the garment within the first, second, third and fourth rectangular sections; wherein said permeable material further comprises portions of the surface of the material embedded with castable elastomeric material; wherein said castable elastomeric material is configured to allow fluid to pass through said permeable material while providing a gripping surface for holding said garment fast.

* * * * *